US007356986B2

(12) United States Patent
Aida et al.

(10) Patent No.: US 7,356,986 B2
(45) Date of Patent: Apr. 15, 2008

(54) EXHAUST GAS PURIFICATION DEVICE

(75) Inventors: Makoto Aida, Kawasaki (JP); Katsuhiro Shibata, Machida (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 103 days.

(21) Appl. No.: 11/314,079

(22) Filed: Dec. 22, 2005

(65) Prior Publication Data

US 2006/0162318 A1 Jul. 27, 2006

(30) Foreign Application Priority Data

Dec. 27, 2004 (JP) ..... 2004-377481
Mar. 16, 2005 (JP) ..... 2005-074806
Nov. 17, 2005 (JP) ..... 2005-332541

(51) Int. Cl.
*F01N 3/00* (2006.01)

(52) U.S. Cl. ..... 60/276; 60/299

(58) Field of Classification Search ..... 60/276, 60/299; 422/179, 180
See application file for complete search history.

(56) References Cited

U.S. PATENT DOCUMENTS 4,172,247 A * 10/1979 Ikeura ..... 338/34
4,278,639 A 7/1981 Tadokoro et al.
6,796,117 B2 * 9/2004 Farmer et al. ..... 60/285
6,945,033 B2 * 9/2005 Sealy et al. ..... 60/285
2004/0105792 A1 6/2004 Worner et al.

FOREIGN PATENT DOCUMENTS

EP 1 422 396 A1 5/2004
JP 2001-280118 A 10/2001

* cited by examiner

*Primary Examiner*—Thomas Denion
*Assistant Examiner*—Diem Tran
(74) *Attorney, Agent, or Firm*—Foley & Lardner LLP

(57) ABSTRACT

An exhaust gas purification device (6) comprises: first and second catalyst carriers (21, 22) interposed in an exhaust passage (8) of an engine (1), which purify an exhaust gas; a case (20) provided in the exhaust passage, which houses the first and second catalyst carriers (21, 22) in series in an exhaust gas flow direction; an annular carrier holder (24) interposed between the first and second catalyst carriers (21, 22), which holds the first and second catalyst carriers (21, 22) via a buffering member (23) and has an opening (34) which connects an inner peripheral side and an outer peripheral side; a sensor (10) which detects the state of the exhaust gas flowing through the interior of the case (20); and a sensor attachment portion (26) provided in the case (20), which connects the interior and exterior of the case (20) in an orientation that is substantially orthogonal to the exhaust gas flow direction. The sensor attachment portion (26) is provided in a position corresponding to the opening (34) when the carrier holder (24) is housed in the case.

15 Claims, 22 Drawing Sheets

B>C

B ≦ C

B > C

EXHAUST GAS PURIFICATION DEVICE

TECHNICAL FIELD OF THE INVENTION

This invention relates to a technique for disposing a plurality of catalyst carriers in an exhaust gas purification device, serially in an exhaust gas flow direction.

BACKGROUND OF THE INVENTION

A diesel particulate filter (DPF hereafter) is known as a device for removing PM discharged from a diesel engine. A DPF is a filter which traps particulate matter (PM) contained in exhaust gas, and is required to perform so-called regeneration processing to remove the trapped PM through oxidation when the trapped PM amount reaches a fixed amount. A method of heating the DPF using a heating device such as a heater when the trapped PM amount reaches a predetermined value is known as a method of performing this regeneration processing, but with this method, a regeneration device must be provided, leading to an increase in cost.

In a known method for solving this problem, an oxidation catalyst (DOC hereafter) is provided in an exhaust passage on the upstream side of the DPF for oxidizing NO contained in the exhaust gas to generate $NO_2$. The DPF is then regenerated by oxidizing the PM trapped the filter continuously using the heat of the exhaust gas and the $NO_2$. In an exhaust gas purification device disclosed in JP2001-280118A, regeneration is performed using this method. The DOC and DPF are housed in a single case, and when the PM amount trapped in the DPF exceeds a predetermined amount, the exhaust gas temperature is raised through post-injection of the fuel and so on in order to burn the trapped PM.

SUMMARY OF THE INVENTION

When performing regeneration processing, it is important to manage the temperature of the exhaust gas that flows into the DPF to ensure that the PM is burned while preventing deterioration of the DPF.

In a known method of detecting the temperature of the exhaust gas flowing into the DPF, a temperature sensor is provided in the vicinity of a DOC inlet, and the exhaust gas temperature after passing through the DOC, or in other words the exhaust gas temperature at the inlet to the DPF, is estimated from the temperature detected by the temperature sensor and a preset temperature increase produced by the oxidation reaction in the DOC. With this method, however, a difference occurs between the preset temperature increase and actual temperature increase due to deterioration of the DOC or the like, and in such cases the inlet temperature of the DPF cannot be estimated accurately.

Hence, a temperature sensor for performing temperature management is preferably provided in the vicinity of the DPF inlet. For similar reasons, a pressure sensor for estimating the trapped PM amount is preferably provided at the inlet part of the DPF.

Furthermore, when the DOC and DPF are housed in a single case and a sensor is disposed in the vicinity of the DPF inlet, the position of the DOC or DPF may shift due to irregularities during assembly or exhaust pressure. As a result, the clearance between the sensor and the DOC or DPF may be narrowed, or interference may occur between the two components, leading to a deterioration in the detection precision. If structures for holding the DOC, DPF, and sensor individually are provided within the case to solve this problem, the case increases in size, leading to restrictions on the location in which the case can be disposed.

JP2001-280118A provides no detailed description regarding the internal structure of the case or the manner in which the DOC and DPF are held, and also discloses that the temperature sensor is disposed on the upstream side of the case.

It is therefore an object of this invention to make an exhaust gas purification device more compact by housing a plurality of catalyst carriers in a single case, and attaching sensors for detecting exhaust gas temperature and so on to an inlet part of the downstream side catalyst.

In order to achieve above-mentioned object, this invention provides an exhaust gas purification device comprising: first and second catalyst carriers interposed in an exhaust passage of an engine, which purify an exhaust gas; a case provided in the exhaust passage, which houses the first and second catalyst carriers in series in an exhaust gas flow direction; an annular carrier holder interposed between the first and second catalyst carriers, which holds the first and second catalyst carriers via a buffering member and has a first opening which connects an inner peripheral side and an outer peripheral side; a first sensor which detects a state of the exhaust gas flowing through the interior of the case; and a first sensor attachment portion provided in the case, which connects the interior and exterior of the case in an orientation that is substantially orthogonal to the exhaust gas flow direction. The first sensor attachment portion is provided in a position corresponding to the first opening when the carrier holder is housed in the case.

The details as well as other features and advantages of this invention are set forth in the remainder of the specification and are shown in the accompanying drawings.

DESCRIPTION OF THE PREFERRED EMBODIMENTS

Embodiments of this invention will now be described with reference to the attached drawings.

First Embodiment

Figure 1:
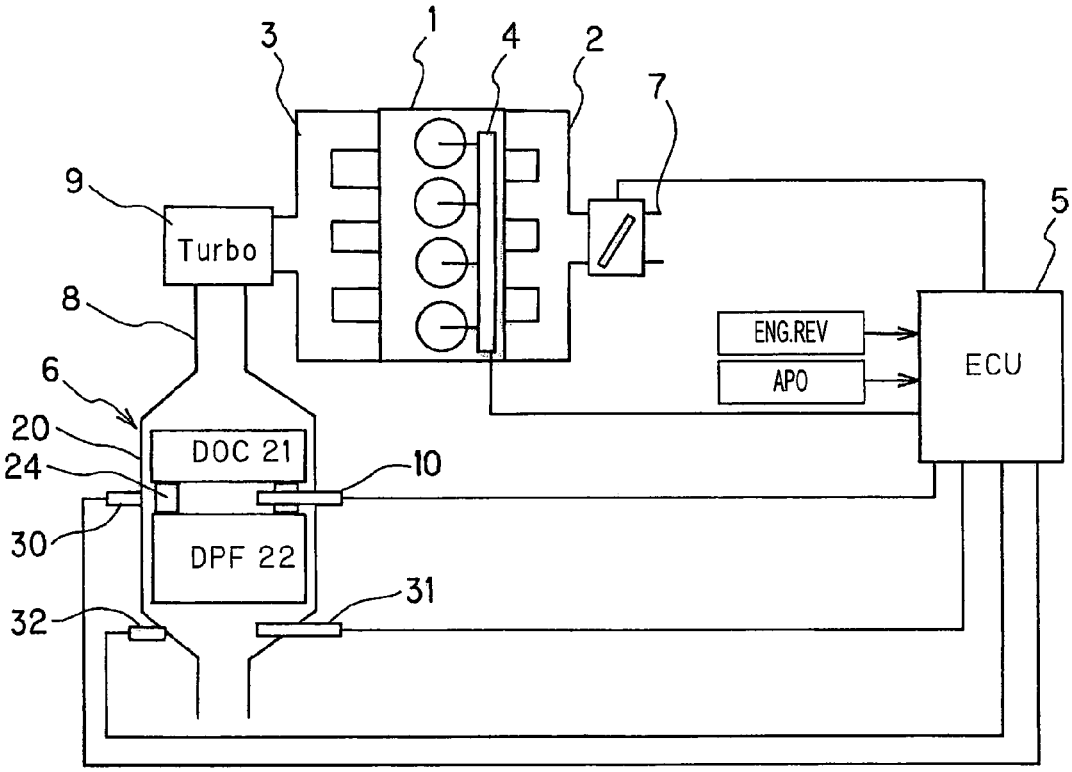
FIG. 1 is a block diagram of a system to which this embodiment is applied.

FIG. 1 is a block diagram showing a case in which an exhaust gas purification device according to this invention is applied to a diesel engine having a turbo supercharger.

An engine 1 is a diesel engine comprising a so-called common rail fuel injection device 4. A turbo supercharger 9 and an exhaust gas purification device 6 are provided in an exhaust passage 8 which is connected to an exhaust manifold 3 of the engine 1. An intake throttle and a compressor (not shown) of the turbo supercharger 9 are provided in an intake passage 7 which is connected to an upstream side of an intake manifold 2 of the engine 1.

A control unit (ECU) 5 reads detection values APO, ENG, REV from a temperature sensor 10, an accelerator depression amount sensor and engine rotation speed sensor not shown in the drawing, and so on, and controls a fuel injection amount, injection timing, and so on of the engine 1 on the basis of these detection values.

In the exhaust gas purification device 6, a DOC 21 (oxidation catalyst, first catalyst carrier) and a DPF 22 (diesel particulate filter, second catalyst carrier) are housed within a single case 20. A cap 24 which holds the DOC 21 and DPF 22, the temperature sensor 10 which detects a temperature upstream of the DPF 22, a pressure sensor 30 which detects a pressure upstream of the DPF 22, a temperature sensor 31 which detects a temperature downstream of the DPF 22, and a pressure sensor 32 which detects a pressure downstream of the DPF 22, are attached to the case 20.

Figure 2:
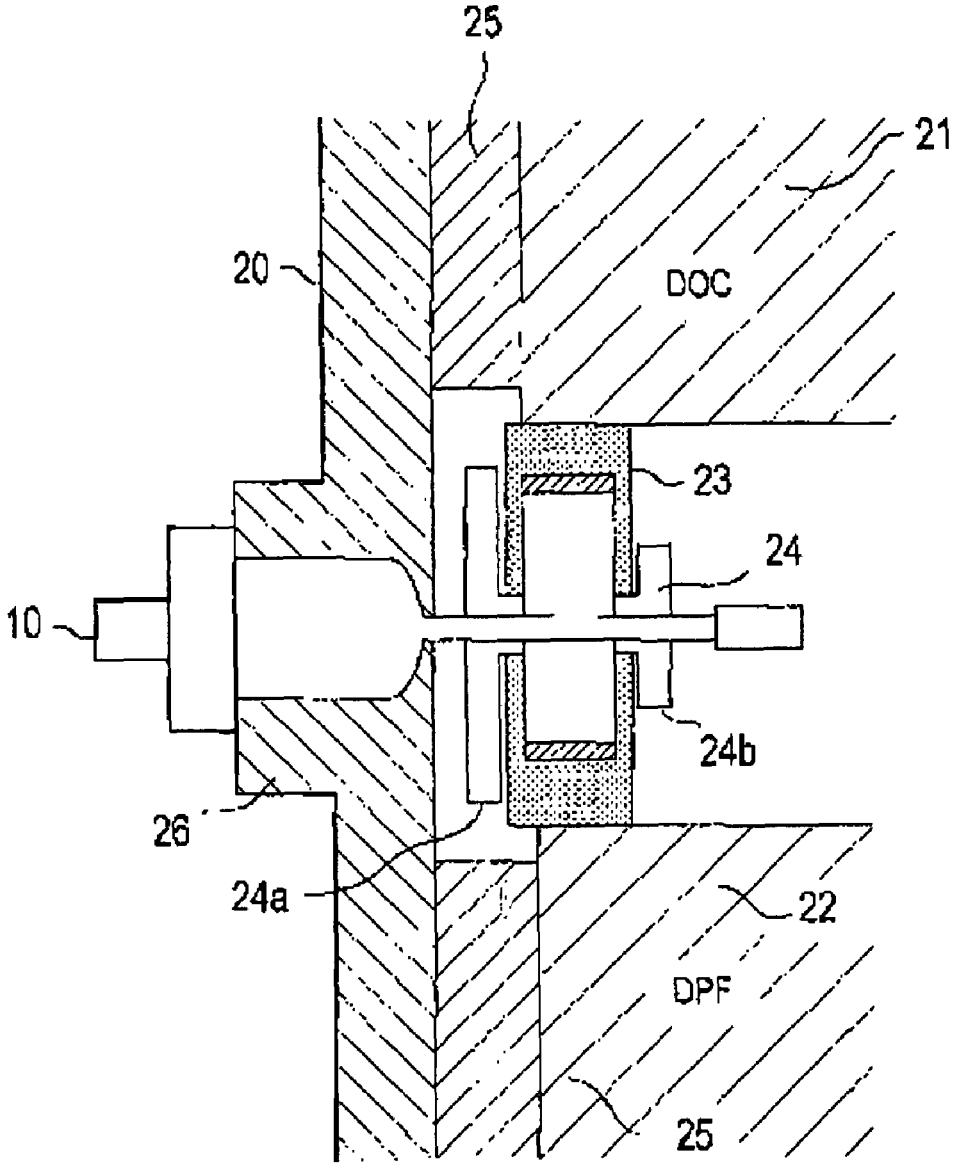
FIG. 2 is a sectional view of the vicinity of holding parts for a DOC and a DPF.

Referring to FIG. 2, the exhaust gas purification device 6 will now be described in more detail. FIG. 2 is a sectional view of the vicinity of a downstream side end portion of the DOC 21 and an upstream side end portion of the DPF 22. The annular cap 24 holds the DOC 21 and DPF 22 via a washer 23. A filler 25 is filled between an outer periphery of the DOC 21 and DPF 22 and an inner peripheral wall of the case 20. The exhaust gas temperature at the inlet to the DPF 22 is detected by the temperature sensor 10.

The washer 23 is an elastic body constituted by wire mesh or the like which is fitted into a gap between an outside edge portion 24*a* and an inside edge portion 24*b* of the cap 24. After being fitted into the gap, the washer 23 may be joined to the cap 24 by welding, adhesion, or another method.

The filler 25 is constituted by matted incombustible fibers. The filler 25 functions mainly to seal the gap between the inner peripheral surface of the case 20 and the outer peripheral surface of the DOC 21 and DPF 22 to ensure that no exhaust gas flows through this part. The DOC 21 and DPF 22 are press-fitted into the case 20 with the filler 25 wound around them.

Thus, the DOC 21 and DPF 22 are housed within the case 20 on the upstream side and downstream side respectively. However, since the cap 24 and washer 23, which have a substantially identical diameter to the DOC 21 and DPF 22, are interposed between the two catalyst carriers, the two catalyst carriers do not come into contact with each other.

A sensor attachment portion 26 is provided in the case 20 in a position corresponding to a bridge 27 of the cap 24, to be described below. As shown in FIG. 2, when the temperature sensor 10 is inserted, a sensing part on the tip end of the temperature sensor 10 is positioned on the inner peripheral side of the cap 24 and between the DOC 21 and DPF 22.

As described above, in the exhaust gas purification device according to this invention, a holder (cap 24A) for the DOC 21 and a holder (cap 24B) for the DPF 22 are integrated such that both the DOC 21 and the DPF 22 are held by a single holder. Therefore, the DOC 21 and DPF 22 can be housed in series within a narrower space than that of the prior art, and a space can be secured for the sensing that is performed by the temperature sensor 10 and so on. Moreover, the number of components interposed between the DOC 21 and DPF 22 can be reduced, enabling a reduction in the number of steps required to assemble the exhaust gas purification device 6.

Furthermore, there is no need to align the positions of both the DOC 21 holder and the DPF 22 holder with the sensor attachment portion 26. Moreover, inaccurate sensing due to a reduction in the clearance between, or interference between, the sensing part of the temperature sensor 10 and the DOC 21 or DPF 22, caused by shifting of the upper and lower holders or the like following assembly of the exhaust gas purification device 6, can be prevented.

Further, since the temperature sensor 10 can be provided between the DOC 21 and DPF 22, or in other words at the inlet part of the DPF 22, appropriate regeneration control can be performed by detecting the temperature of the exhaust gas flowing into the DPF 22 even when the temperature increase produced by the oxidation reaction decreases due to deterioration of the DOC 21 or the like.

Referring to FIGS. 2 and 3A-3C, the structure of the cap attachment portion will be described in further detail.

Figure 3A:
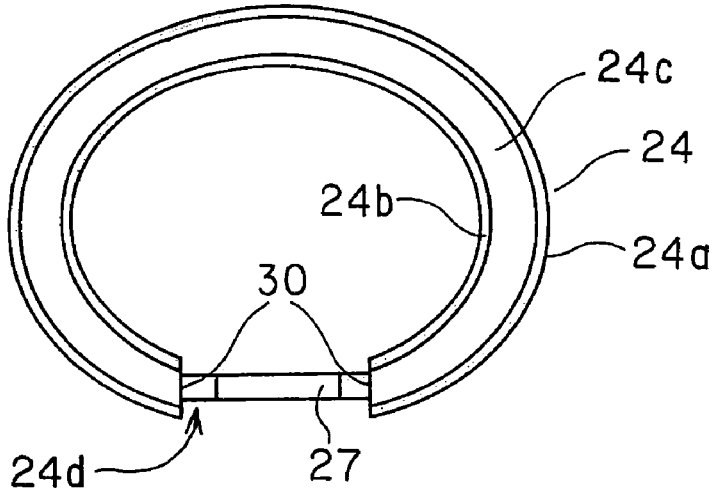
FIGS. 3A-3C illustrate a first embodiment, FIG. 3A being a top view of a cap, FIG. 3B being a side view of the cap seen from a sensor attachment portion side, and FIG. 3C being a sectional view along IIIb-IIIb in FIG. 3B.
Figure 3B:
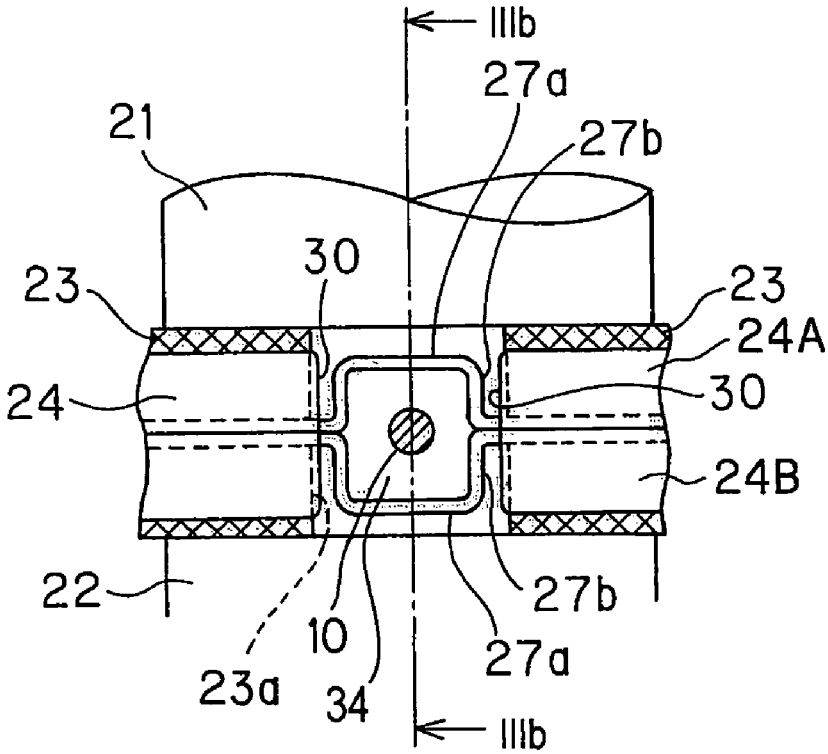
Figure 3C:
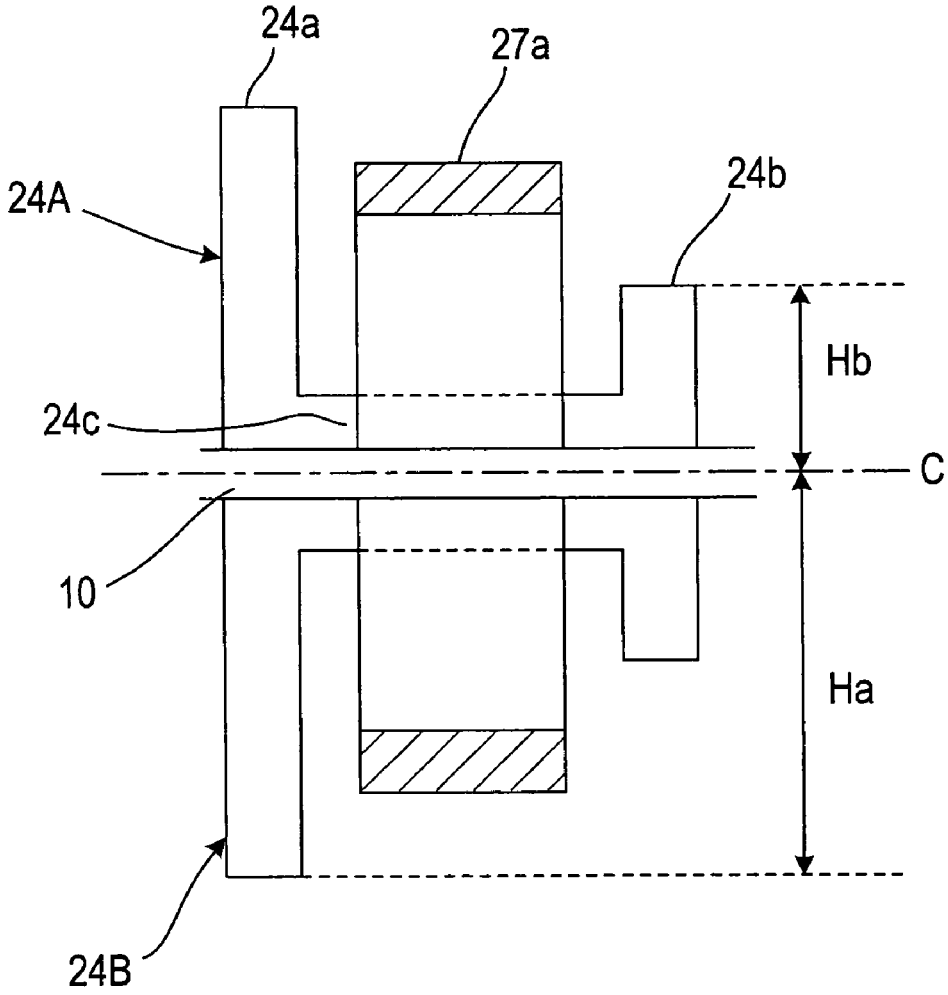

FIG. 3A is a top view of the cap 24, FIG. 3B is a side view of the cap 24 seen from the sensor attachment portion 26 side, and FIG. 3C is a sectional view along IIIb-IIIb in FIG. 3B.

The cap 24 has a substantially identical diameter to the DOC 21 and DPF 22, and as shown in FIG. 2, is constituted by the outside edge (outside edge portion hereafter) 24*a*, which serves as an outer wall portion on the outer peripheral side, the inside edge (inside edge portion hereafter) 24*b*, which serves as an inner wall portion on the inner peripheral side, and a base portion 24*c*, which serves as a connection portion connecting the substantially central parts of the outside edge portion 24*a* and inside edge portion 24*b*. The cap 24 has a substantially H-shaped sectional form in which the outside edge portion 24*a* and inside edge portion 24*b* extend substantially parallel to each other from the outer peripheral edge and inner peripheral edge of the base portion 24*c*, respectively, toward both the upstream side and downstream side.

When seen from above, the cap 24 has a substantially C-shaped annular form comprising a notch portion 24*d* that is formed by cutting away a part of the outside edge portion 24*a* and inside edge portion 24*b*. The notch portion 24*d* is joined by the base portion 24*c* (bridge 27 hereafter), which is not cut away. The outside edge portion 24*a* is positioned on the outside of the DOC 21 and DPF 22.

By positioning the cap 24 described above such that the bridge 27 is in alignment with the sensor attachment portion 26 of the case 20, a space required for sensing the temperature can be secured between the DOC 21 and DPF 22. Furthermore, by providing the bridge 27, the strength of the cap 24 can be improved in comparison with a substantially C-shaped form in which notch portions are merely provided for mounting the temperature sensor 10.

It should be noted that the cap 24 is constituted by the DOC cap 24A which holds the DOC 21 and the DPF cap 24B which holds the DPF 22, and both of the caps 24A, 24B have a substantially U-shaped cross-section constituted by the outside edge portion 24*a*, inside edge portion 24*b*, and base portion 24*c*. After aligning the notch portions 24*d*, the base portions 24*c* of the two caps 24A, 24B are welded together to obtain the substantially H-shaped cross-section shown in FIG. 3C.

Further, as shown in FIG. 3C, a height Ha from a joint line C of the cap 24A and the cap 24B to the end portion of the outside edge portion 24*a* is greater than a height Hb from the joint line C to the end portion of the inside edge portion 24*b*.

As shown in FIG. 3B, the bridge 27 is constituted by wall surfaces 27*b* (first wall portions) which are substantially perpendicular to the base portion 24*c*, and upper surfaces 27*a* (second wall portions) which are substantially parallel to the base portion 24*c*, thereby forming a substantially square opening 34. As shown in FIG. 3C, the upper surface 27*a* is provided in a higher position than the upper end of the inside edge portion 24*b*. The substantially square shaped part formed by the bridge 27 is provided in a position corresponding to the sensor attachment portion 26, and the sensing part of the temperature sensor 10 penetrates this part.

By forming the upper surface 27*a* of the bridge 27 higher than the upper end of the inside edge portion 24*b* in this manner, the bridge upper surface 27*a* acts as a stopper when the washer 23 contracts due to temporal deterioration, exhaust pressure, and so on, when-the DOC 21 or DPF 22 shifts position, and in other such situations. Hence, damage to the DOC 21 or DPF 22 caused by contact with the inside edge portion 27*b* can be prevented. Moreover, space is secured between the DOC 21 and DPF 22 and the temperature sensor 10, and therefore the temperature sensor 10 can perform accurate sensing.

Further, the wall surface 27*b* of the bridge 27 is formed substantially perpendicular to the base portion 24*c*, and therefore an end 30 of the notch portion 24*d* in the cap 24 is blocked by the wall surface 27*b*. Hence, an end surface 23*a* of the washer 23 near the end 30 of the notch portion 24*d* is unlikely to be exposed to the exhaust gas flowing through the interior of the case 20, and as a result, it is possible to prevent corrosion and scattering of the washer 23 by the exhaust gas.

In this embodiment, the upper surface 27*a* and wall surface 27*b* of the bridge 27 are formed by bending a part of the annular base portion 24*c*, but the base portion 24*c* may be molded into a C shape, and a notch portion in the base portion 24*c* may be joined by a bridge 27 which is formed separately.

Furthermore, the bridge 27 is not limited to a single location, and may be provided in a plurality when a pressure sensor or the like is provided in addition to the temperature sensor 10, as described below. Moreover, in this embodiment the cap 24 is formed from the DOC cap 24A and DPF cap 24B, which are formed separately and then integrated by welding, but the cap 24 may be formed as a single body from the beginning.

Also in this embodiment, an example was described in which the DOC 21 is provided on the upstream side, the DPF 22 is provided on the downstream side, and the temperature sensor 10 is provided between the DOC 21 and DPF 22. However, the catalyst carriers are not limited to the DOC 21 and DPF 22, and for example, the upstream side catalyst carrier may be an NOx catalyst, and the downstream side catalyst carrier may be a three way catalyst. Furthermore, the sensor 10 is not limited to a temperature sensor, and may be a pressure sensor, for example.

The bridge 27 is not limited to the shape described above, and may take a form such as those shown in FIGS. 4A-4C and FIGS. 5A-5C.

Figure 4A:
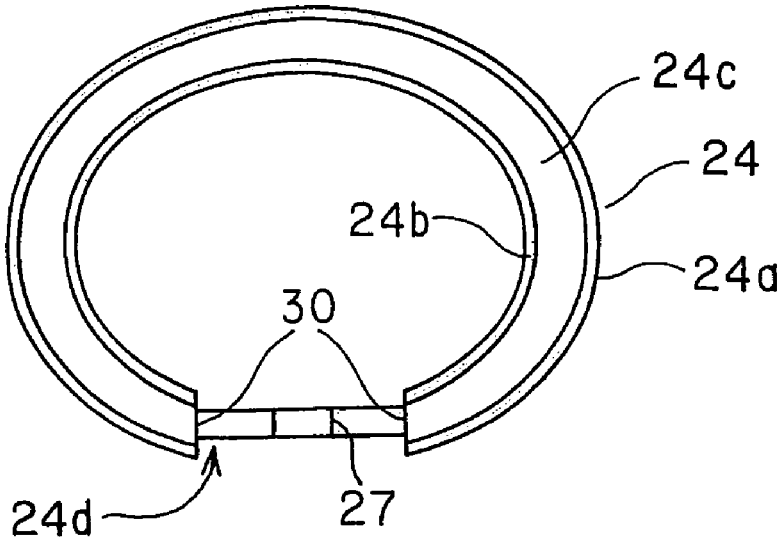
FIGS. 4A-4C illustrate a partially modified example of the first embodiment, FIG. 4A being a top view of the cap, FIG. 4B being a side view of the cap seen from the sensor attachment portion side, and FIG. 4C being a sectional view along IVb-IVb in FIG. 4B.
Figure 4B:
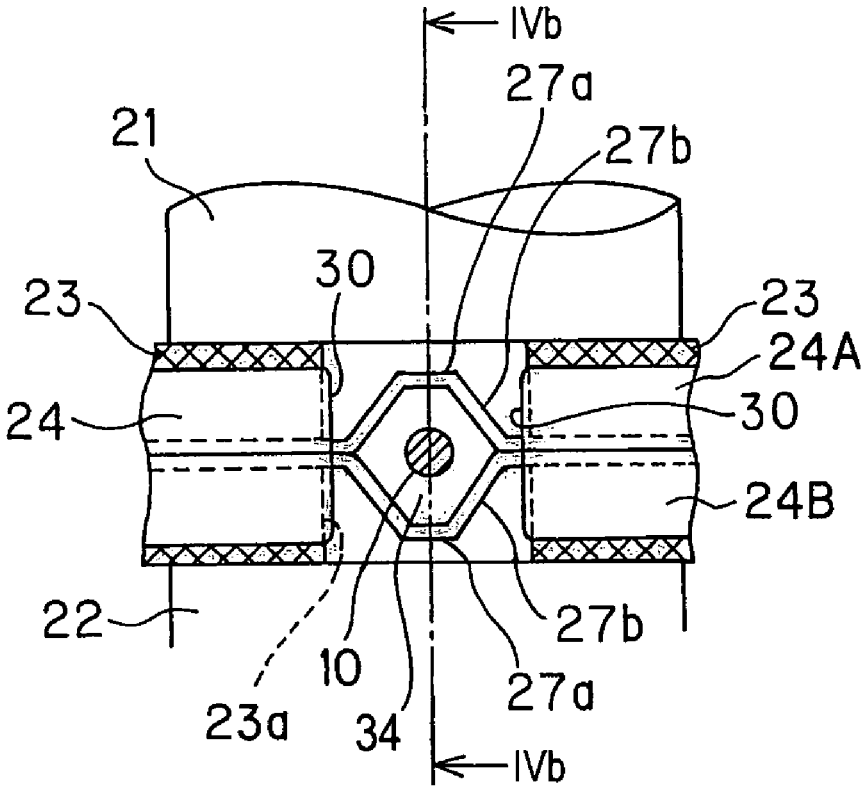
Figure 4C:
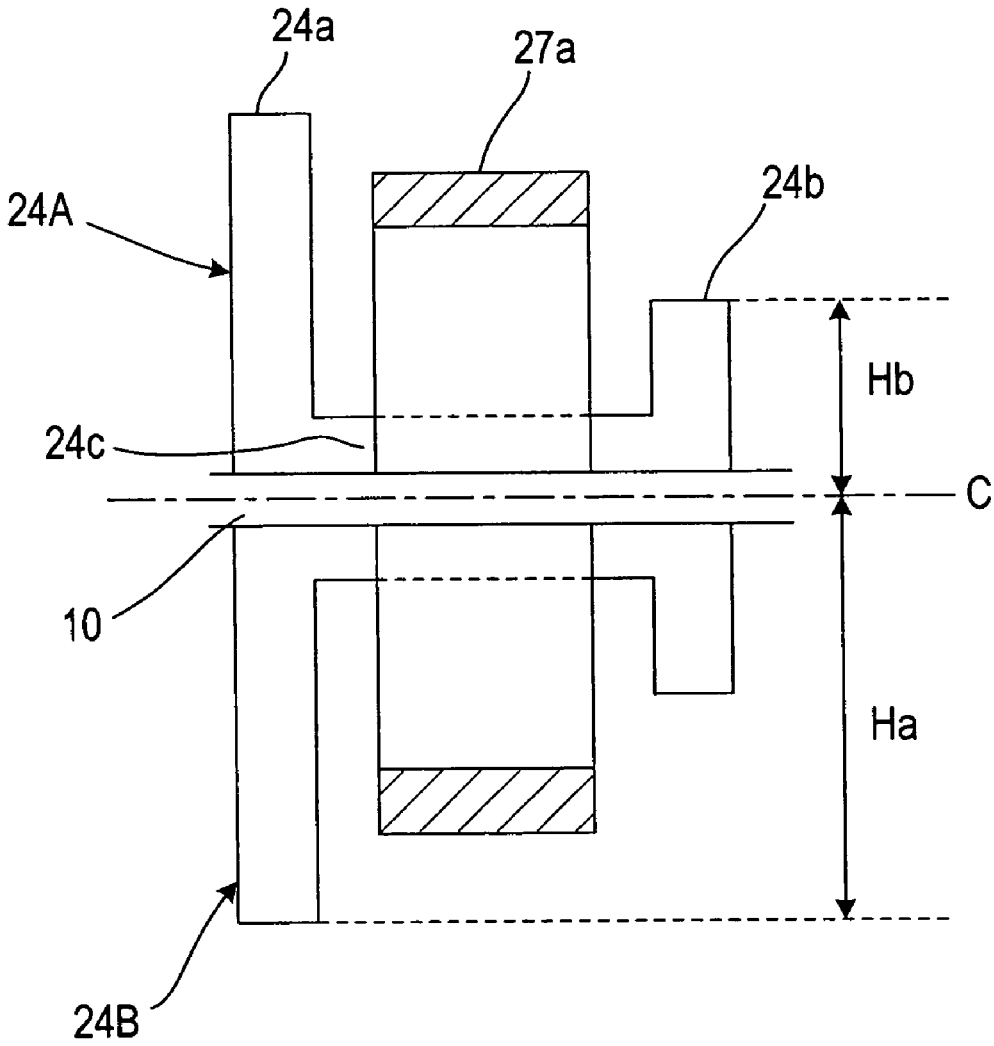

FIGS. 4A-4C show the upper face, side face, and cross-section of the cap 24, similarly to FIGS. 3A-3C. In this example, as shown in FIG. 4B, the bridge 27 takes a substantially hexagonal shape formed by the wall surfaces 27*b*, which extend from the base portion 24*c* toward the DOC 21 side and DPF 22 side so as to recede from the respective ends 30, and the upper surfaces 27*a*, which connect the upper ends and the lower ends of the wall surfaces 27*b* to each other, respectively. In this case also, the upper surface 27*a* is positioned higher than the upper end of the inside edge portion 24*b*.

Figure 5A:
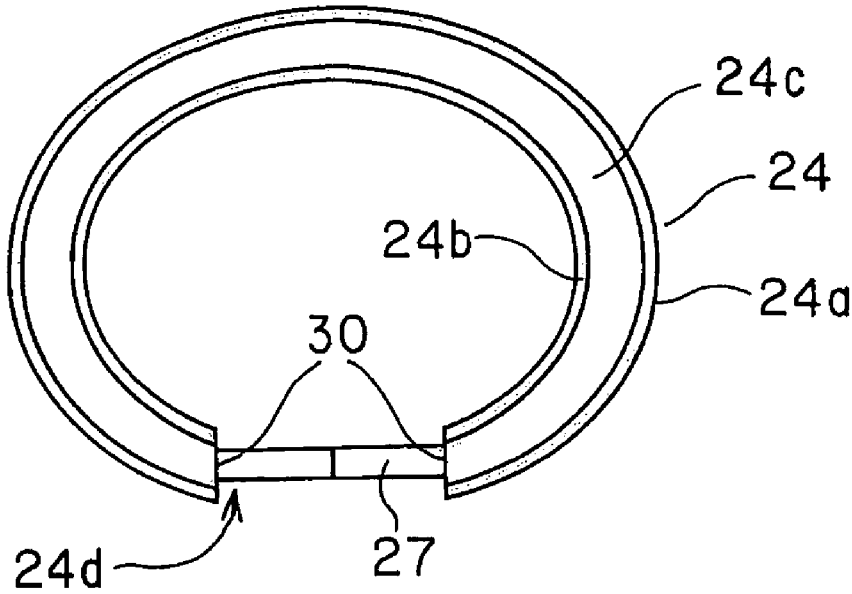
FIGS. 5A-5C illustrate a partially modified example of the first embodiment, FIG. 5A being a top view of the cap, FIG. 5B being a side view of the cap seen from the sensor attachment portion side, and FIG. 5C being a sectional view along Vb-Vb in FIG. 5B.
Figure 5B:
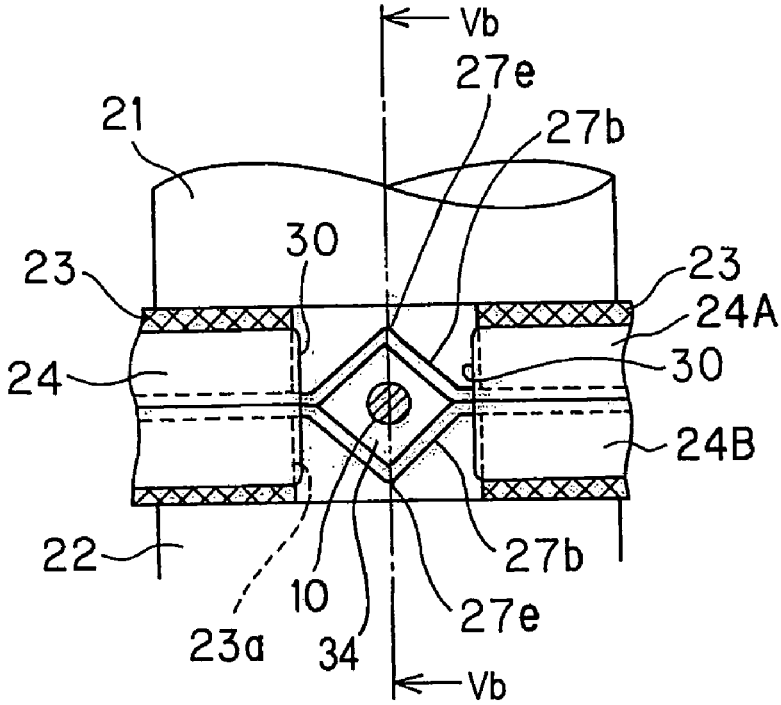
Figure 5C:
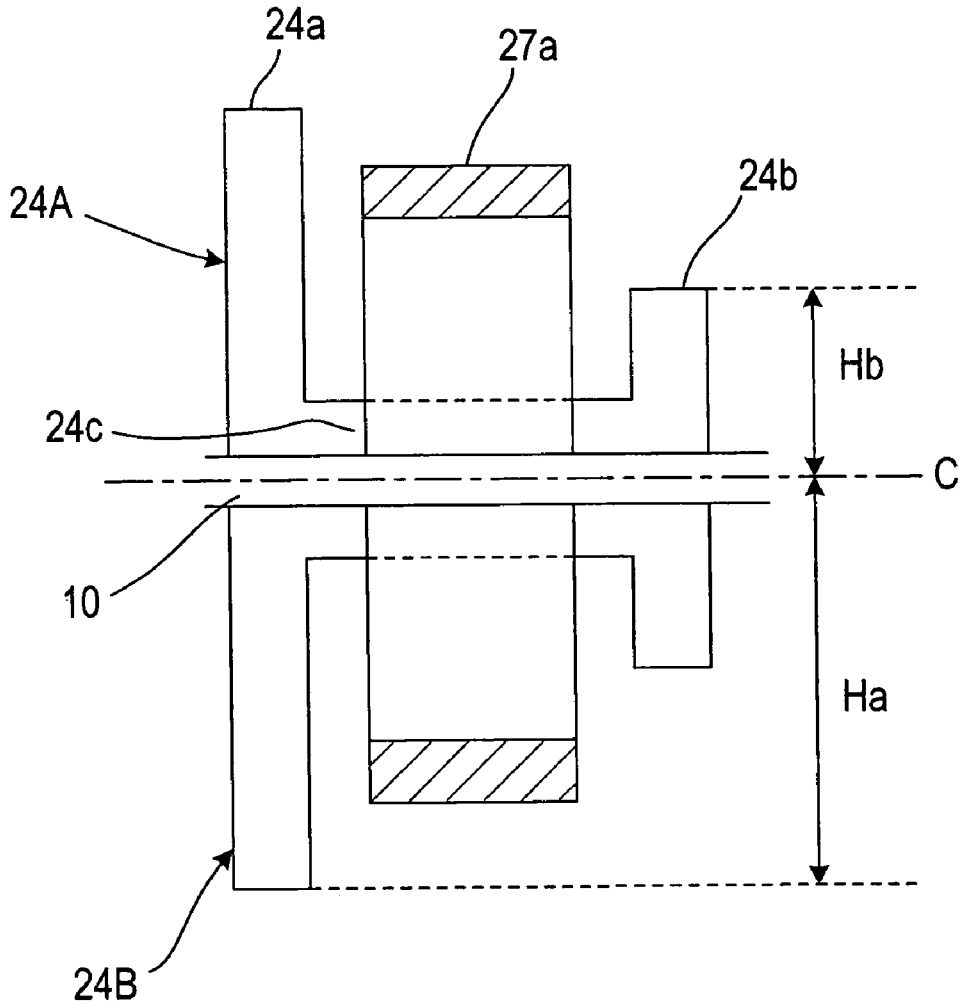

FIGS. 5A-5C also show the upper face, side face, and cross-section of the cap 24, similarly to FIGS. 3A-3C. In this example, as shown in FIG. 5B, the bridge 27 takes a substantially square shape in which the wall surfaces 27*b* extend from the base portion 24*c* toward the DOC 21 side and DPF 22 side so as to recede from the respective ends 30, and the tip end portions of the wall surfaces 27*b* meet in the substantial center of the notch portion 24*d*. In this case, a connection portion 27*e* between the wall surfaces 27*b* is positioned higher than the upper end of the inside edge portion 24*b*.

The actions and effects of the first embodiment will now be summarized.

The exhaust gas purification device 6 comprises the DOC 21, the DPF 22, the case 20 housing the DOC 21 and DPF 22 in series in the flow direction of the exhaust gas, the cap 24 interposed between the DOC 21 and DPF 22, which holds the DOC 21 and DPF 22 via the washer 23, the notch portion provided in the cap 24, the temperature sensor 10 which detects the state of the exhaust gas flowing through the interior of the case 20, and the sensor attachment portion 26 provided in the case 20. The sensor attachment portion 26 is provided in a position corresponding to the notch portion in the cap 24 when the cap 24 is housed in the case 20, and therefore the DOC 21 and DPF 22 can be accommodated in the single case 20 in a compact manner, and the temperature of the exhaust gas at the inlet part of the DPF 22 can be detected.

In consideration of advantageous conditions for regenerating the DPF 22, the case 20 housing the DOC 21 and DPF 22 is preferably disposed in a location where the exhaust gas temperature is high, for example directly below the exhaust manifold 3 of the engine 1 or directly below the turbo supercharger 9 in the case of a vehicle installed with the turbo supercharger 9. In an engine room, however, space is lacking directly below the turbo supercharger 9, and therefore in the past it has been difficult to dispose the single case 20 housing the DOC 21 and DPF 22 in such a location. According to this invention, on the other hand, the exhaust gas purification device 6 has a compact constitution, and can therefore be disposed in the small space directly beneath the turbo supercharger 9.

By integrating the cap 24 and washer 23, the number of components can be reduced, and the number and steps required to assemble the exhaust gas purification device 6 can be reduced.

A carrier holder is constituted by the substantially C-shaped cap 24 having the notch portion 24*d* in a part of the circumference thereof and the bridge 27 which bridges the notch portion 24*d* in the cap 24, and the bridge 27 forms a space for the sensor 10. Thus the carrier holder is stronger than a C-shaped ring member which is merely provided with a notch portion in a part of the circumference thereof.

The bridge 27 is constituted by the wall surfaces 27*b*, which extend from the base portion 24*c* in the upstream and downstream directions of the exhaust gas flow so as to block the two ends of the notch portion 24*d*, and the upper surfaces 27*a* which connect the upstream side end portions and the downstream side end portions of the wall surfaces 27*b* to each other, respectively. Thus the bridge 27 forms a tubular part which connects the inner peripheral side and outer peripheral side of the cap 24, enabling a space required for the sensing performed by the sensor 10 to be secured.

The distance from the base portion 24*c* to the upper surface 27*a* is longer than the distance from the base portion 24*c* to the end portion of the inside edge portion 24*b*, and therefore the upper surface 27*a* acts as a stopper when the DOC 21 or DPF 22 shifts position due to deterioration of the washer 23, exhaust pressure, and so on. Therefore, a space required for the sensing performed by the sensor 10 can be secured, and damage to the DOC 21 and DPF 22 caused by interference with the inside edge portion 24*b* can be prevented.

Second Embodiment

A second embodiment of this invention will now be described. The second embodiment differs from the first embodiment in that two sensor attachment portions 26, 28 are provided in the cap 24, and the temperature sensor 10 and pressure sensor 30 are attached to the respective sensor attachment portions 26, 28. The overall constitution of the device is identical to that shown in FIG. 1. The peripheral structures of the attachment portions for the temperature sensor 10 and pressure sensor 30 are substantially identical to the structures shown in FIG. 2 except that in the peripheral structure of the attachment portion 28 for the pressure sensor 30, a sensing part 30*a* on the tip end of the pressure sensor 30 does not penetrate a bridge 33.

Figure 6A:
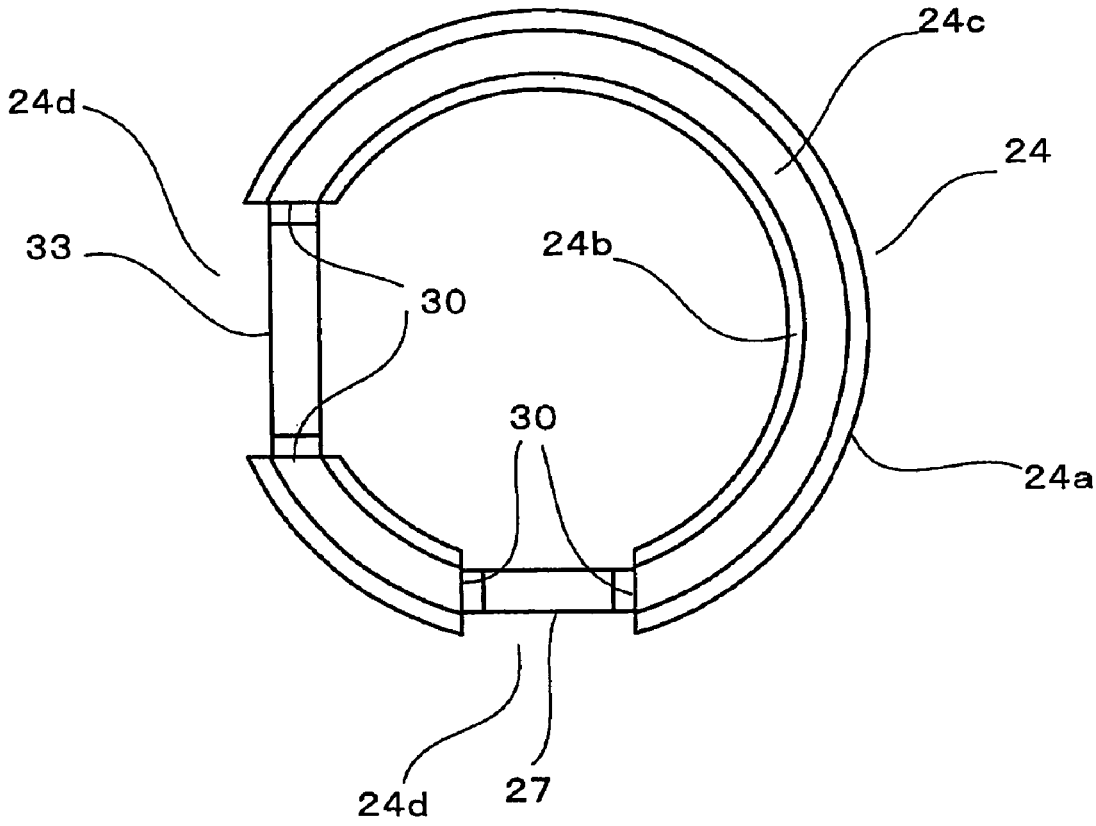
FIGS. 6A-6C illustrate a second embodiment, FIG. 6A being a top view of a cap, FIG. 6B being a side view of the cap seen from a sensor attachment portion side, and FIG. 6C being a sectional view along VIb-VIb in FIG. 6B.
Figure 6B:
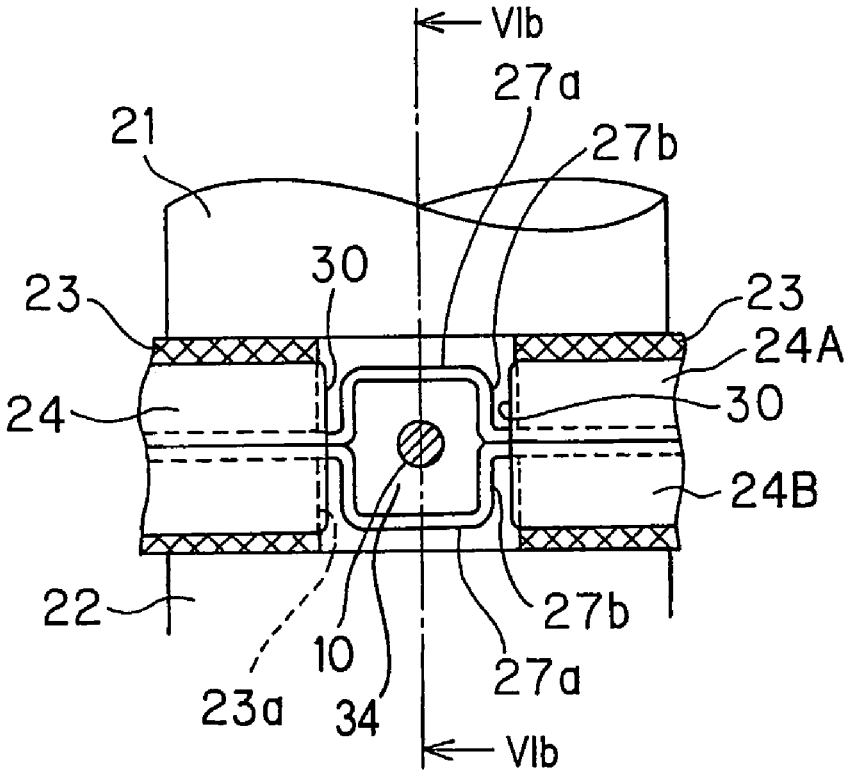
Figure 6C:
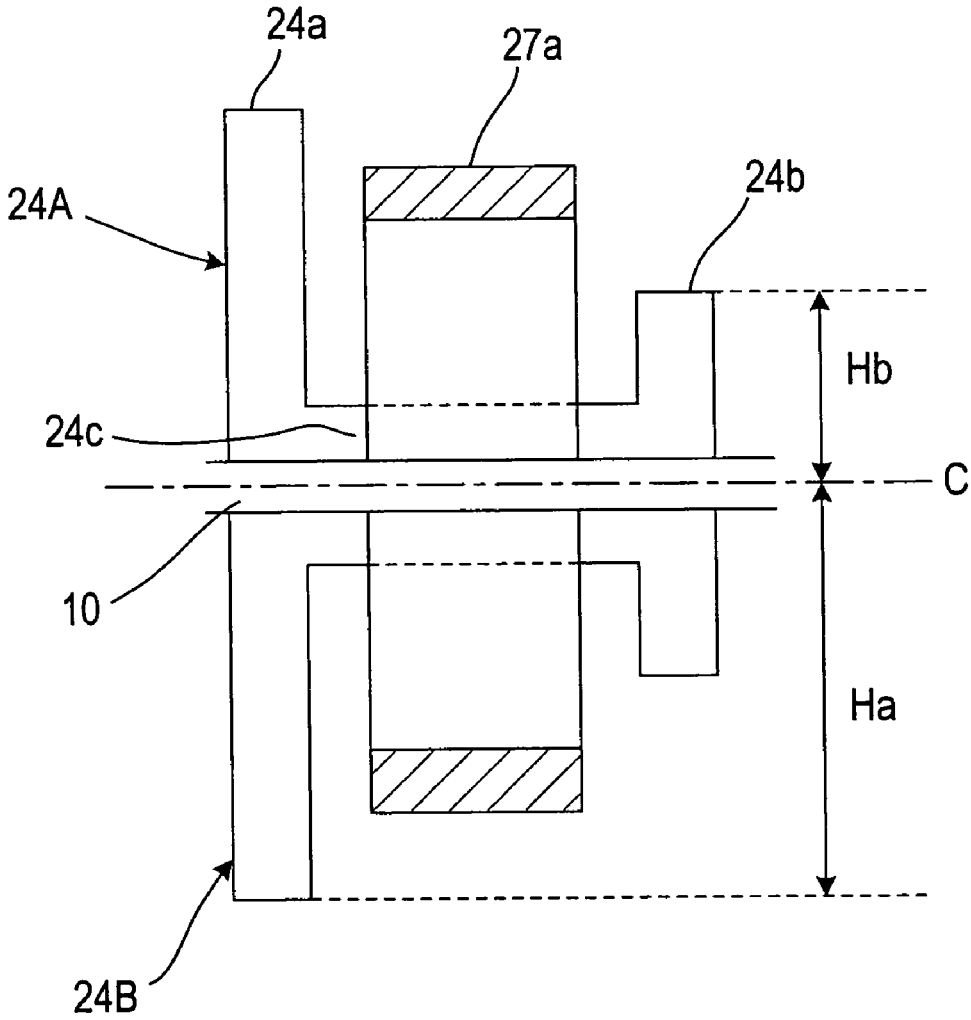

FIG. 6A is a top view of the cap 24 according to the second embodiment, FIG. 6B is a side view of the cap 24 seen from the sensor attachment portion 26 side, and FIG. 6C is a sectional view along VIb-VIb in FIG. 6B. A side view of the cap 24 seen from the sensor attachment portion 28 side and the sectional view thereof are similar to FIGS. 6B and 6C.

The cap 24 has a substantially identical diameter to the DOC 21 and DPF 22, and as shown in FIG. 2, is constituted by the outside edge (outside edge portion hereafter) 24*a*, which serves as an outer wall portion on the outer peripheral side, the inside edge (inside edge portion hereafter) 24*b*, which serves as an inner wall portion on the inner peripheral side, and the base portion 24*c*, which serves as a connection portion connecting the substantially central parts of the outside edge portion 24*a* and inside edge portion 24*b*. The cap 24 has a substantially H-shaped sectional form in which the outside edge portion 24*a* and inside edge portion 24*b* extend substantially parallel to each other from the outer peripheral edge and inner peripheral edge of the base portion 24*c*, respectively, toward both the upstream side and downstream side.

The notch portions 24*d* are provided in two locations in the outside edge portion 24*a* and inside edge portion 24*b* when the cap 24 is seen from above, and the notch portions 24*d* are joined by the base portion 24*c* (bridge 27, bridge 33 hereafter), which is not cut away. The outside edge portion 24*a* is positioned on the outside of the DOC-21 and DPF 22.

By disposing the cap 24 described above such that the bridges 27, 33 are in alignment with the respective sensor attachment portions 26, 28 of the case 20, the spaces required for the sensing performed by the temperature sensor 10 and pressure sensor 30 can be secured between the DOC 21 and DPF 22. Furthermore, by providing the bridges 27, 33, the cap 24 having the notch portions 24*d* in two locations can be formed as an integral member.

It should be noted that the cap 24 is constituted by the DOC cap 24A which holds the DOC 21 and the DPF cap 24B which holds the DPF 22, and both of the caps 24A, 24B have a substantially U-shaped cross-section constituted by the outside edge portion 24*a*, inside edge portion 24*b*, and base portion 24*c*. After aligning the notch portions 24*d*, the base portions 24*c* of the two caps 24A, 24B are welded together to obtain the substantially H-shaped cross-section shown in FIG. 6C.

Further, as shown in FIG. 6C, the height Ha from the joint line C of the cap 24B to the end portion of the outside edge portion 24*a* is greater than the height Hb from the joint line C to the end portion of the inside edge portion 24*b*.

As shown in FIG. 6B, the bridge 27 is constituted by the wall surfaces 27*b* (first wall portions), which are substantially perpendicular to the base portion 24*c*, and the upper surfaces 27*a* (second wall portions), which are substantially parallel to the base portion 24*c*, thereby forming the substantially square opening 34. As shown in FIG. 6C, the upper surface 27*a* is provided in a higher position than the upper end of the inside edge portion 24*b*. The substantially square shaped part formed by the bridge 27 is provided in a position corresponding to the sensor attachment portion 26, and the sensing part of the temperature sensor 10 penetrates this part.

By forming the upper surface 27*a* of the bridge 27 higher than the upper end of the inside edge portion 24*b* in this manner, the bridge upper surface 27*a* acts as a stopper when the washer 23 contracts due to temporal deterioration, exhaust pressure, and so on, when the DOC 21 or DPF 22 shifts position, and in other such situations. Hence, damage to the DOC 21 or DPF 22 caused by contact with the inside edge portion 27*b* can be prevented. Moreover, space is secured between the DOC 21 and DPF 22 and the temperature sensor 10, and therefore the temperature sensor 10 can perform accurate sensing.

Further, the wall surface 27*b* of the bridge 27 is formed substantially perpendicular to the base portion 24*c*, and therefore the end 30 of the notch portion 24*d* in the cap 24 is blocked by the wall surface 27*b*. Hence, the end surface 23*a* of the washer 23 near the end 30 of the notch portion 24*d* is unlikely to be exposed to the exhaust gas flowing through the interior of the case 20, and as a result, it is possible to prevent corrosion and scattering of the washer 23 by the exhaust gas.

In this embodiment, the upper surface 27*a* and wall surface 27*b* of the bridge 27 are formed by bending a part of the annular base portion 24*c*, but the base portion 24*c* may be molded into a C shape, and a notch portion in the base portion 24*c* may be joined by a bridge 27 which is formed separately.

The bridge 33 has a similar structure to the bridge 27, and hence description thereof has been omitted.

The bridges 27, 33 are not limited to the shape described above, and may take a form such as those shown in FIGS. 7A-7C and FIGS. 8A-8C. It should be noted that since the bridge 27 and the bridge 33 are structured similarly, only the bridge 27 will be described.

Figure 7A:
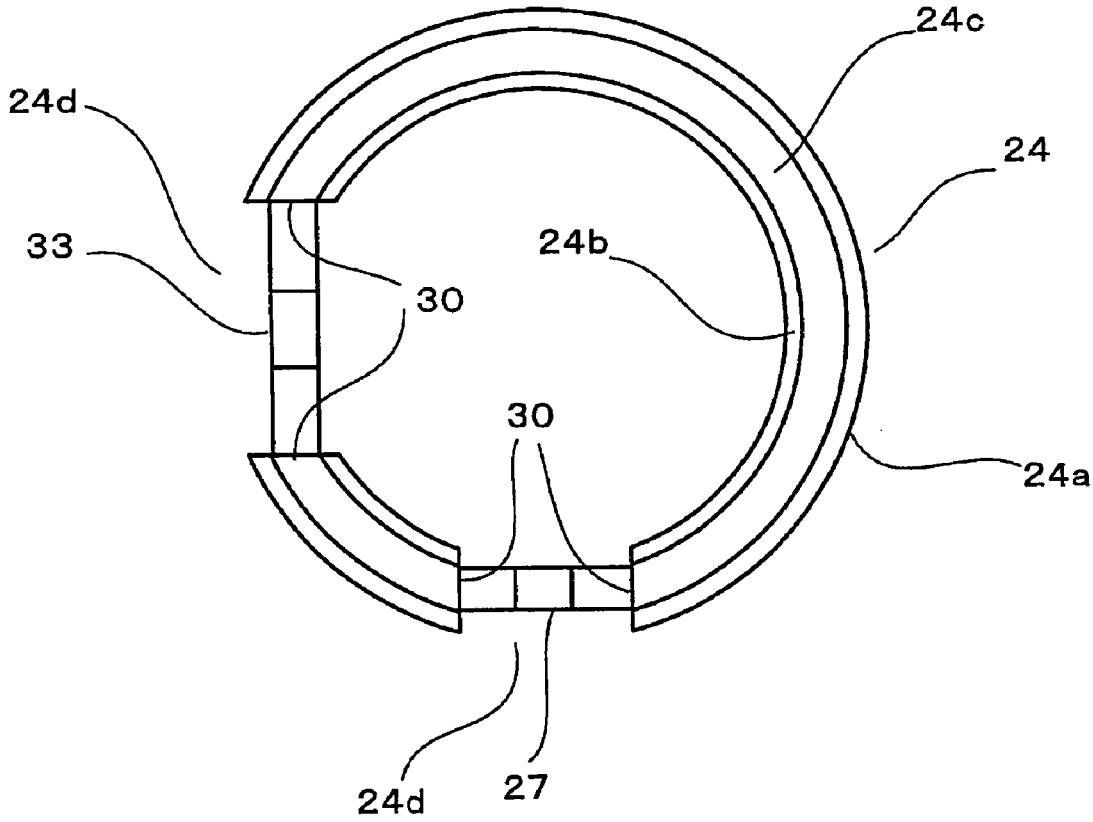
FIGS. 7A-7C illustrate a partially modified example of the second embodiment, FIG. 7A being a top view of the cap, FIG. 7B being a side view of the cap seen from the sensor attachment portion side, and FIG. 7C being a sectional view along VIIb-VIIb in FIG. 7B.
Figure 7B:
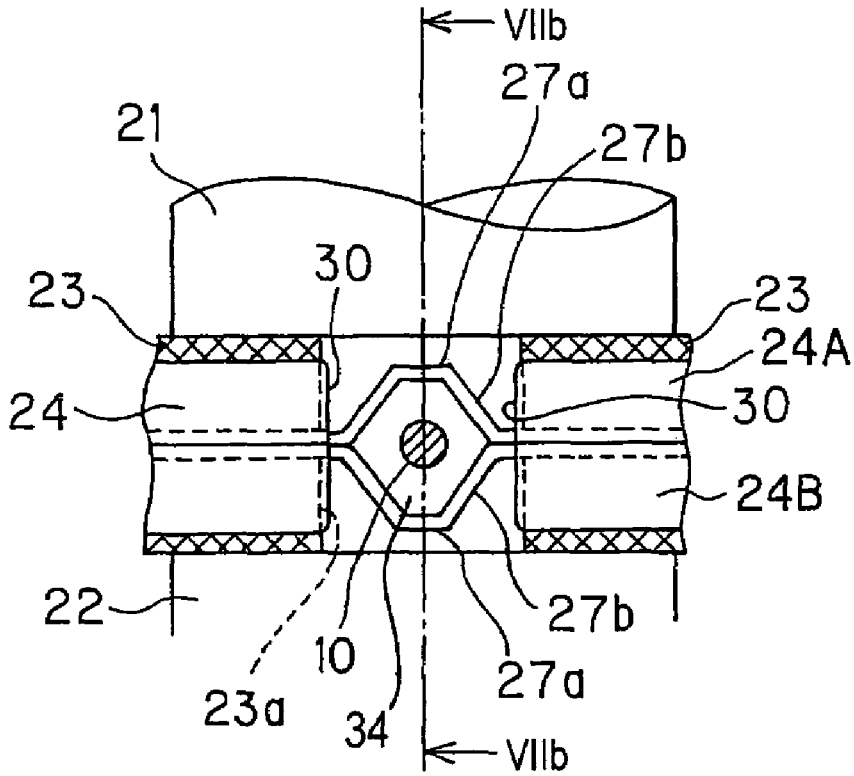
Figure 7C:
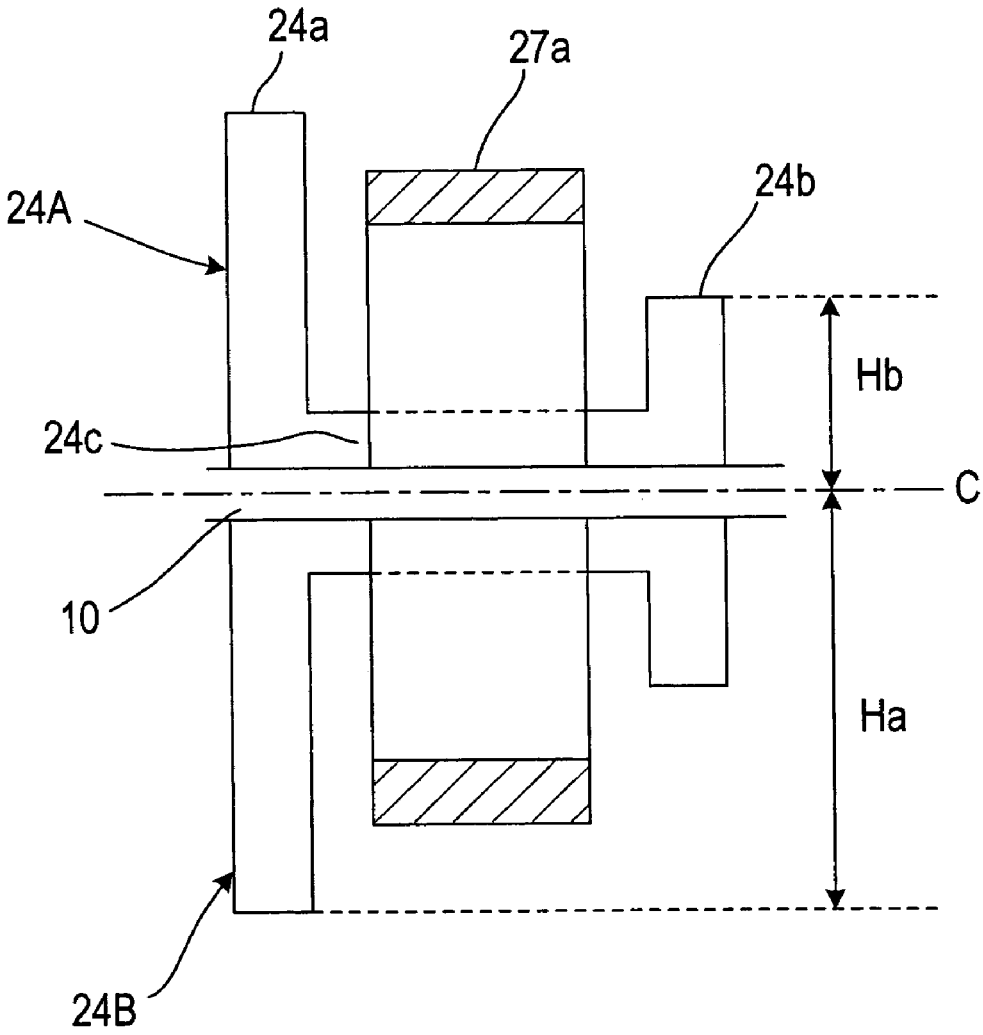

FIGS. 7A-7C show the upper face, side face, and cross-section of the cap 24, similarly to FIGS. 6A-6C. In this example, as shown in FIG. 7B, the bridge 27 takes a substantially hexagonal shape formed by the wall surfaces 27*b*, which extend from the base portion 24*c* toward the DOC 21 side and DPF 22 side so as to recede from the respective ends 30, and the upper surfaces 27*a*, which connect the upper ends and the lower ends of the wall surfaces 27*b* to each other, respectively. In this case also, the upper surface 27*a* is positioned higher than the upper end of the inside edge portion 24*b*.

Figure 8A:
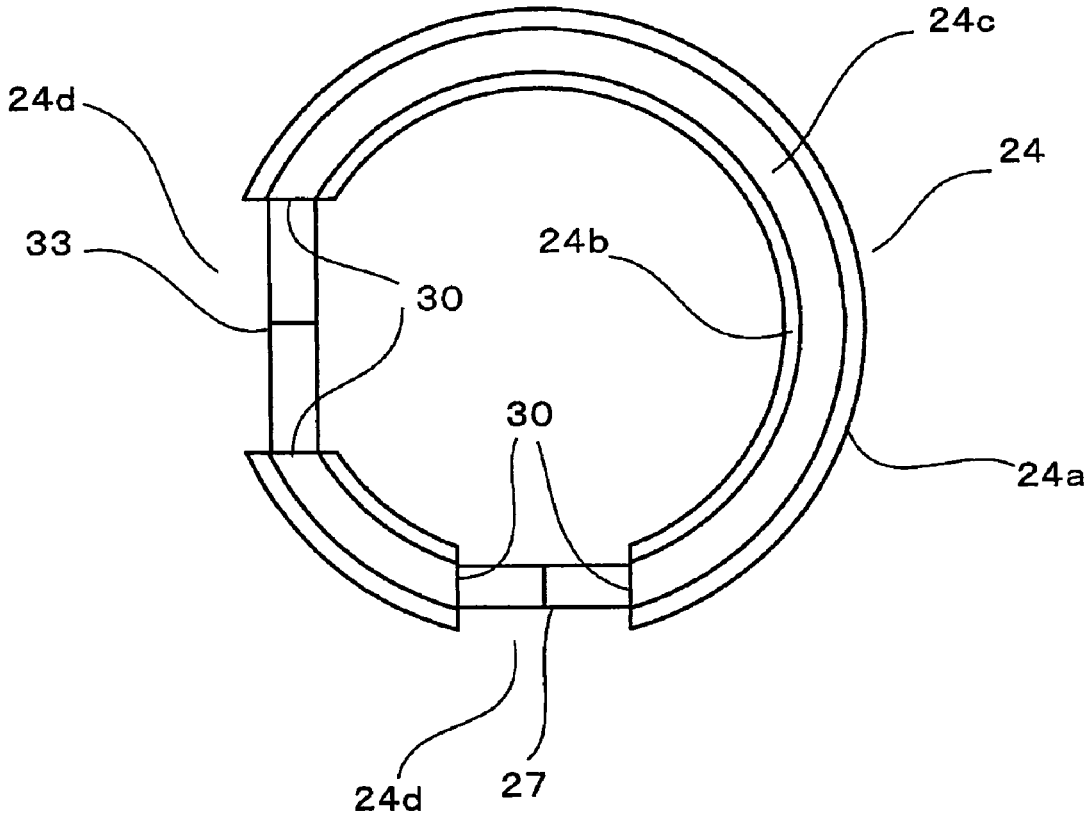
FIGS. 8A-8C illustrate a partially modified example of the second embodiment, FIG. 8A being a top view of the cap, FIG. 8B being a side view of the cap seen from the sensor attachment portion side, and FIG. 8C being a sectional view along VIIIb-VIIIb in FIG. 8B.
Figure 8B:
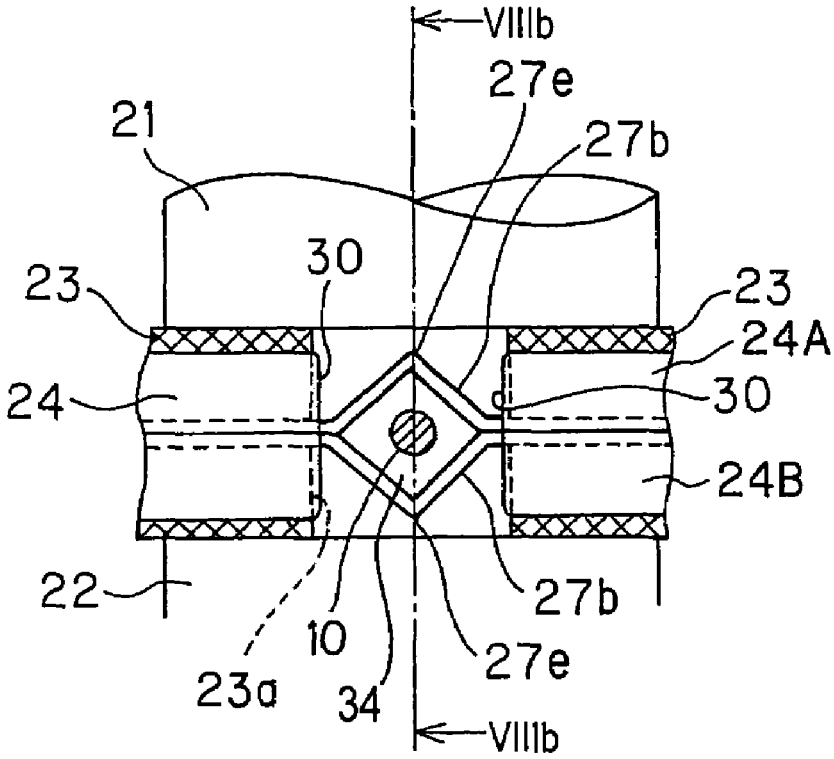
Figure 8C:
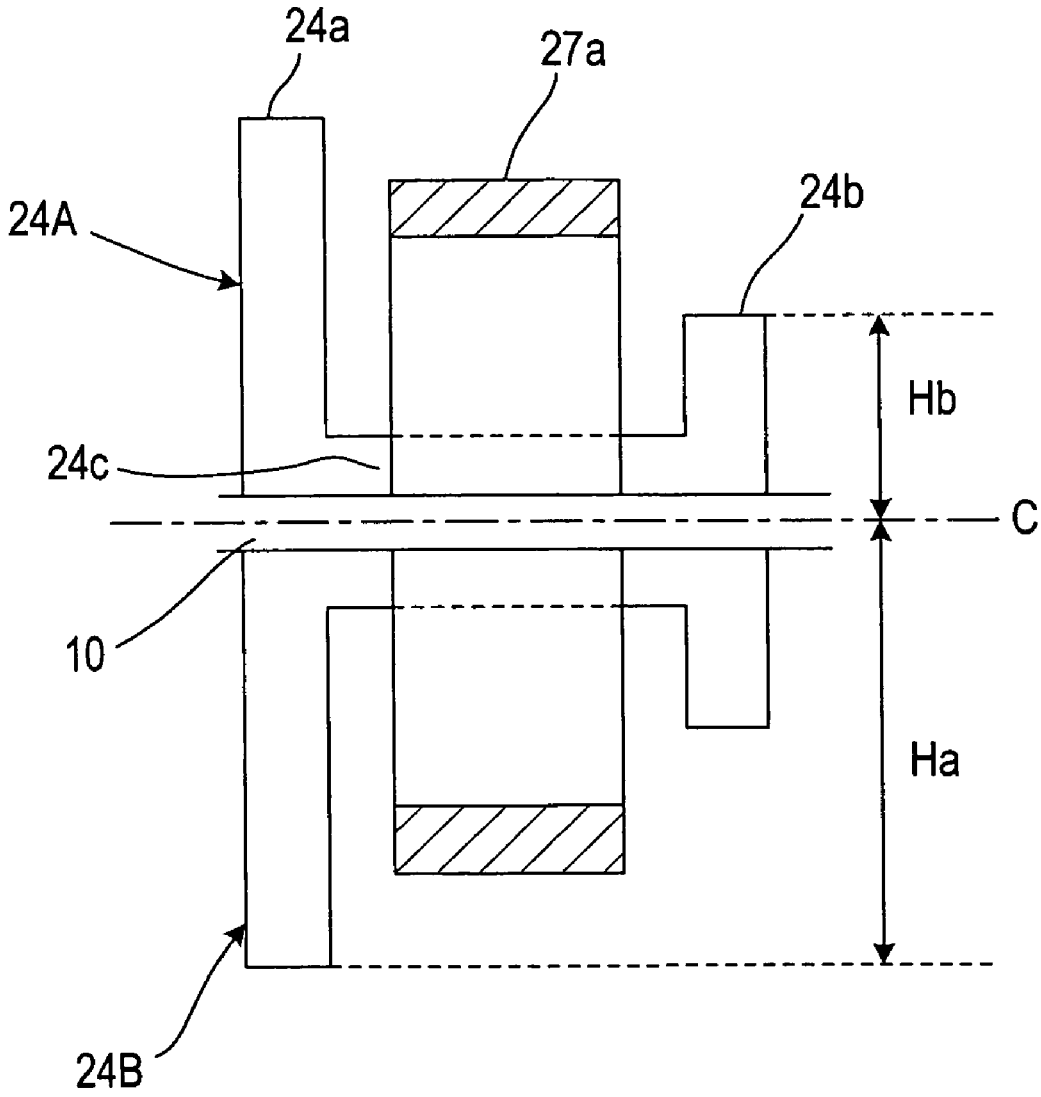

FIGS. 8A-8C also show the upper face, side face, and cross-section of the cap 24, similarly to FIGS. 6A-6C. In this example, as shown in FIG. 8B, the bridge 27 takes a substantially square shape in which the wall surfaces 27*b* extend from the base portion 24*c* toward the DOC 21 side and DPF 22 side so as to recede from the respective ends 30, and the tip end portions of the wall surfaces 27*b* meet in the substantial center of the notch portion 24*d*. In this case, the connection portion 27*e* between the wall surfaces 27*b* is positioned higher than the upper end of the inside edge portion 24*b*.

Next, the relationship between the bridge 27 and the bridge 33 will be described with reference to FIGS. 9, 10A, and 10B.

Figure 9:
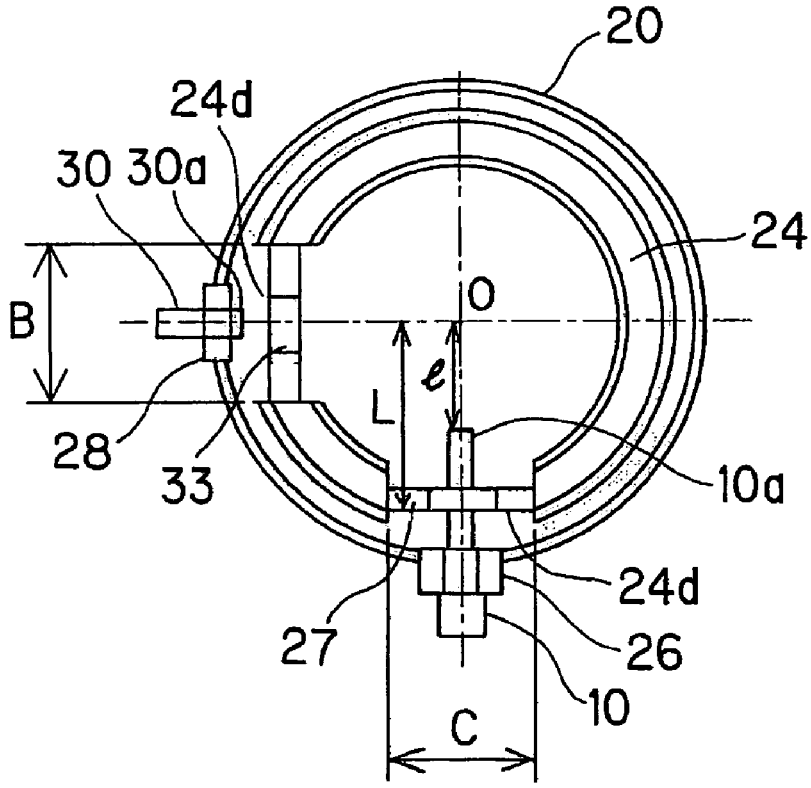
FIG. 9 is a view illustrating the relationship between a bridge and a bridge in the second embodiment.
Figure 10A:
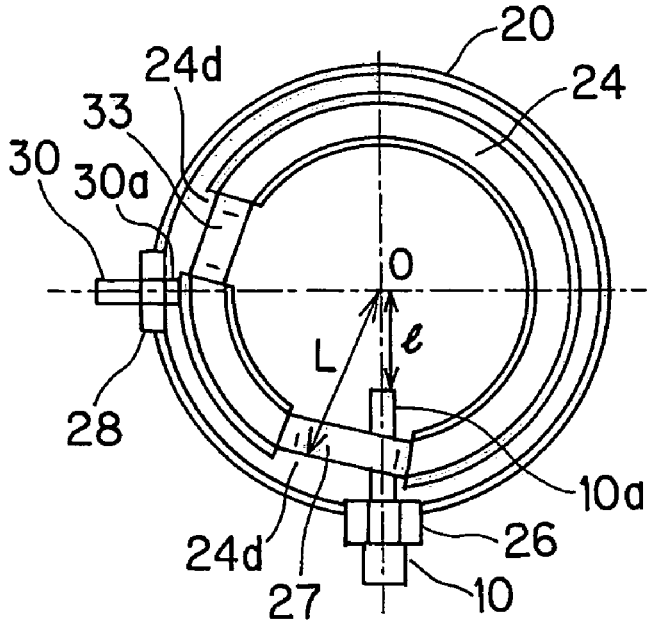
FIG. 10A is a schematic diagram showing a state in which the cap is rotated within a case.
Figure 10B:
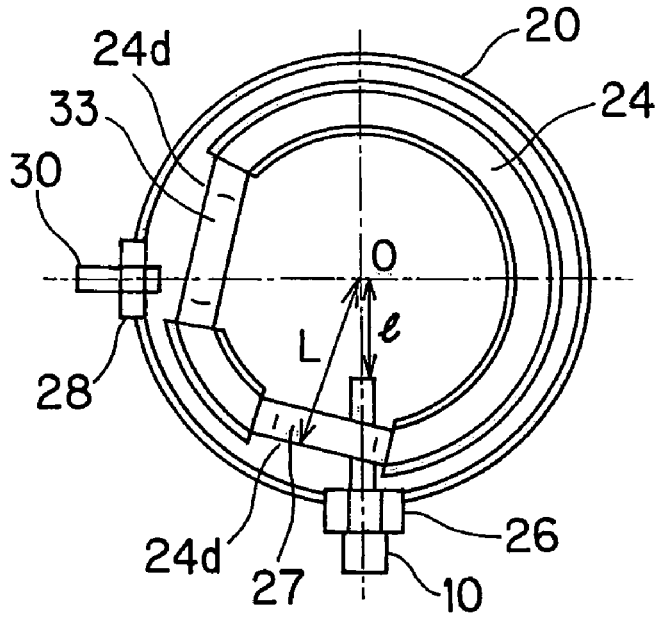
FIG. 10B is a schematic diagram showing a state in which the cap is rotated within a case.

FIG. 9 is a schematic diagram seen from the upper face of the case 20, and FIGS. 10A, 10B are views showing states in which the cap 24 is rotated in the interior of the case 20.

The temperature sensor 10 and pressure sensor 30 are attached to the case 20 such that the respective tip ends thereof are oriented in the axial center direction of the case 20. The sensing part 10*a* of the temperature sensor 10 penetrates the central portion of the bridge 27 in the circumferential direction, while the pressure sensor 30 is attached in a position facing the central portion of the bridge 33 in the circumferential direction. The sensing part 30*a* of the pressure sensor 30 is shorter than the sensing part 10*a* of the temperature sensor 10, and therefore the sensing part 30*a* does not penetrate the opening in the bridge 33. A length B of the bridge 33 in the circumferential direction is greater than a length C of the bridge 27 in the circumferential direction.

The cap 24 may rotate in the circumferential direction due to deterioration of the washer 23, filler 25, and so on, or vibration and the like generated during traveling. The angle of this rotation reaches a maximum when the wall surface 27*b* of the bridge 27 interferes with the sensing part 10*a* of the temperature sensor 10.

As shown in FIG. 10A, if the circumferential direction length C of the bridge 27 is greater than the circumferential direction length B of the bridge 33, the sensing part 30*a* of the pressure sensor 30 faces the outside edge portion 24*a* when the cap 24 rotates in the clockwise direction of FIG. 9 to the aforesaid maximum rotation angle, for example, and hence the required sensing space cannot be secured.

In the second embodiment, on the other hand, the circumferential direction length B of the bridge 33 is greater than the circumferential direction length C of the bridge 27, and therefore the pressure sensor 30 is exposed through the opening in the bridge 33 even at the maximum rotation angle, as shown in FIG. 10B. Hence, the required sensing space can be secured. This relationship is established likewise when the rotation direction of the cap 24 is opposite to that shown in FIGS. 10A, 10B.

Thus in the second embodiment, the space required for the sensing performed by the temperature sensor 10 and pressure sensor 30 is secured even when the cap 24 rotates within the case 20. As a result, the precision with which the amount of soot in the DPF and so on are estimated on the basis of the detection values of the sensors 10, 30 is not reduced by rotation of the cap 24, and therefore deterioration of the DPF, decreased fuel economy, and similar problems can be prevented.

It should be noted that in this embodiment, the angle formed by the temperature sensor 10 and pressure sensor 30 is set at substantially ninety degrees, but this invention is not limited thereto.

In addition to the actions and effects of the first embodiment, the second embodiment exhibits the following actions and effects.

The carrier holder is constituted by the cap 24 having notch portions 24*d* in two circumferential locations when seen from the exhaust gas flow direction, and the bridges 27, 33 bridging the notch portions 24*d* in the cap 24. As a result, a space for the temperature sensor 10 can be formed by the bridge 27, and a space for the pressure sensor 30 can be formed by the bridge 33.

By constituting the bridge 33 and bridge 27 in a similar manner, a space required for the sensing performed by the pressure sensor 30 can be secured, and interference between the DOC 21 or DPF 22 and the inside edge portion 24*b* can be prevented.

The circumferential direction length of the bridge 27 is shorter than the circumferential direction length of the bridge 33, and therefore, even when the cap 24 rotates in the circumferential direction to a point where it interferes with the sensing part 10*a* of the temperature sensor 10 due to temporal deterioration, vibration generated when the vehicle is in motion, or a similar cause, the sensing part 30*a* of the pressure sensor 30 faces the opening in the bridge 33, and hence both the temperature sensor 10 and the pressure sensor 30 are able to perform sensing reliably.

The entire contents of Japanese Patent Applications P2004-377481 (filed on Dec. 27, 2004), P2005-74806 (filed on Mar. 16, 2005) and P2005-332541 (filed on Nov. 17, 2005) are incorporated herein by reference.

Although the invention has been described above by reference to a certain embodiment of the invention, the invention is not limited to the embodiment described above. Modifications and variations of the embodiments described above will occur to those skilled in the art, in the light of the above teachings. The scope of the invention is defined with reference to the following claims.

What is claimed is:

1. An exhaust gas purification device comprising:

first and second catalyst carriers interposed in an exhaust passage of an engine, which purify an exhaust gas;

a case provided in the exhaust passage, which houses the first and second catalyst carriers in series in an exhaust gas flow direction;

an annular carrier holder interposed between the first and second catalyst carriers, which holds the first and second catalyst carriers via a buffering member and has a first opening which connects an inner peripheral side and an outer peripheral side;

a first sensor which detects a state of the exhaust gas flowing through the interior of the case; and a first sensor attachment portion provided in the case, which connects the interior and exterior of the case in an orientation that is substantially orthogonal to the exhaust gas flow direction, wherein the first sensor attachment portion is provided in a position corresponding to the first opening when the carrier holder is housed in the case, wherein the carrier holder comprises:

a substantially C-shaped annular support member having a notch portion in a circumference thereof when seen from the exhaust gas flow direction; and a bridge which bridges the notch portion, and the bridge forms the first opening.

2. The exhaust gas purification device as defined in claim 1, wherein the annular support member comprises:

an outer wall portion forming an outer peripheral surface;

an inner wall portion forming an inner peripheral surface; and a connection portion connecting the outer wall portion and the inner wall portion, the outer wall portion and the inner wall portion are disposed substantially coaxially, and a substantially central part of the outer wall portion and a substantially central part of the inner wall portion in respective up/downstream directions thereof are connected by the connection portion such that the annular support member is substantially H-shaped.

3. The exhaust gas purification device as defined in claim 1, wherein the engine comprises a supercharger.

4. The exhaust gas purification device as defined in claim 1, wherein the case is disposed directly downstream of a part at which the exhaust passages of each cylinder of the engine converge.

5. The exhaust gas purification device as defined in claim 1, wherein the engine comprises a turbo supercharger, which is driven by exhaust energy, and the case is disposed directly downstream of a turbine of the turbo supercharger.

6. The exhaust gas purification device as defined in claim 1, wherein the carrier holder and the buffering member are integrated.

7. The exhaust gas purification device as defined in claim 1, wherein the first sensor is a temperature sensor which detects a temperature of the exhaust gas.

8. The exhaust gas purification device as defined in claim 1, wherein the bridge comprises:

first wall portions which extend in an upstream direction and a downstream direction of the exhaust gas flow so as to block both ends of the notch portion; and second wall portions which connect upstream side end portions and downstream side end portions of the first wall portions to each other, respectively, and a tubular part comprises the first and second wall portions connects the inner peripheral side and the outer peripheral side of the annular support member.

9. The exhaust gas purification device as defined in claim 8, wherein a distance from the connection portion to the respective second wall portions in the upstream and downstream directions is longer than a distance from the connection portion to respective end portions of the inner wall portion in the upstream and downstream directions.

10. An exhaust gas purification device comprising:

first and second catalyst carriers interposed in an exhaust passage of an engine, which purify an exhaust gas;

a case provided in the exhaust passage, which houses the first and second catalyst carriers in series in an exhaust gas flow direction;

an annular carrier holder interposed between the first and second catalyst carriers, which holds the first and second catalyst carriers via a buffering member and has a first opening which connects an inner peripheral side and an outer peripheral side;

a first sensor which detects a state of the exhaust gas flowing through the interior of the case;

a first sensor attachment portion provided in the case, which connects the interior and exterior of the case in an orientation that is substantially orthogonal to the exhaust gas flow direction, wherein the first sensor attachment portion is provided in a position corresponding to the first opening when the carrier holder is housed in the case;

a second sensor which detects the state of the exhaust gas flowing through the interior of the case; and a second sensor attachment portion provided in the case, which connects the interior and exterior of the case in an orientation that is substantially orthogonal to the exhaust gas flow direction, wherein the carrier holder has a second opening which connects an inner peripheral side and an outer peripheral side, the second sensor attachment portion is provided in a position corresponding to the second opening when the carrier holder is housed in the case, and when the case is seen from the exhaust gas flow direction with the carrier holder housed in the case and the first and second sensors attached to the first and second sensor attachment portions respectively, a distance from a center of the case to a tip end portion of the first sensor is shorter than a distance from the center of the case to an outer peripheral portion of the carrier holder, and the second opening is larger than the first opening.

11. The exhaust gas purification device as defined in claim 10, wherein a tip end portion of the second sensor is positioned outside the outer peripheral portion of the carrier holder.

12. An exhaust gas purification device comprising:

first and second catalyst carriers interposed in an exhaust passage of an engine, which purify an exhaust gas;

a case provided in the exhaust passage, which houses the first and second catalyst carriers in series in an exhaust gas flow direction;

an annular carrier holder interposed between the first and second catalyst carriers, which holds the first and second catalyst carriers via a buffering member and has a first opening which connects an inner peripheral side and an outer peripheral side;

a first sensor which detects a state of the exhaust gas flowing through the interior of the case;

a first sensor attachment portion provided in the case, which connects the interior and exterior of the case in an orientation that is substantially orthogonal to the exhaust gas flow direction, wherein the first sensor attachment portion is provided in a position corresponding to the first opening when the carrier holder is housed in the case;

a second sensor which detects the state of the exhaust gas flowing through the interior of the case; and a second sensor attachment portion provided in the case, which connects the interior and exterior of the case in an orientation that is substantially orthogonal to the exhaust gas flow direction, wherein the carrier holder has a second opening which connects an inner peripheral side and an outer peripheral side, the second sensor attachment portion is provided in a position corresponding to the second opening when the carrier holder is housed in the case, wherein the carrier holder comprises:

an annular support member having first and second notch portions in a circumference thereof when seen from the exhaust gas flow direction; and first and second bridges which bridge the first and second notch portions respectively, the first bridge forming the first opening, and the second bridge forming the second opening.

13. The exhaust gas purification device as defined in claim 12, wherein the annular support member comprises:

an outer wall portion forming an outer peripheral surface;

an inner wall portion forming an inner peripheral surface; and a connection portion connecting the outer wall portion and the inner wall portion, the outer wall portion and the inner wall portion are disposed substantially coaxially, and a substantially central part of the outer wall portion and a substantially central part of the inner wall portion in respective up/downstream directions thereof are connected by the connection portion such that the annular support member is substantially H-shaped.

14. The exhaust gas purification device as defined in claim 12, wherein the bridge comprises:

first wall portions which extend in an upstream direction and a downstream direction of the exhaust gas flow so as to block both ends of the notch portion; and second wall portions which connect upstream side end portions and downstream side end portions of the first wall portions to each other, respectively, and a tubular part comprises the first and second wall portions connects the inner peripheral side and the outer peripheral side of the annular support member.

15. The exhaust gas purification device as defined in claim 14, wherein a distance from the connection portion to the respective second wall portions in the upstream and downstream directions is longer than a distance from the connection portion to respective end portions of the inner wall portion in the upstream and downstream directions.

* * * * *